United States Patent [19]

Grüllmeier

[11] 4,288,987

[45] Sep. 15, 1981

[54] PNEUMO-HYDRAULIC BOOSTER WITH RAPID-TRAVERSE FEATURE

[75] Inventor: Artur Grüllmeier, Salem, Fed. Rep. of Germany

[73] Assignees: Eugen Rapp, Berg; Paul Haug, Aichwald, both of Fed. Rep. of Germany

[21] Appl. No.: 92,450

[22] Filed: Nov. 7, 1979

[30] Foreign Application Priority Data

Nov. 11, 1978 [DE] Fed. Rep. of Germany ..... 2849113

[51] Int. Cl.[3] ..... F15B 7/08

[52] U.S. Cl. ..... 60/560; 60/593

[58] Field of Search ..... 60/560, 563, 574, 583, 60/593; 91/426

[56] References Cited

U.S. PATENT DOCUMENTS 3,145,627 8/1964 Neukom ..... 60/574
3,270,625 9/1966 Huntington ..... 91/426
3,406,703 10/1968 Gordon ..... 91/426
4,192,222 3/1980 Dits ..... 91/517

FOREIGN PATENT DOCUMENTS 2505553 4/1976 Fed. Rep. of Germany ..... 60/593

*Primary Examiner*—Abraham Hershkovitz

[57] ABSTRACT

The invention relates to a pneumo-hydraulic booster with rapid-traverse feature, particularly for driving punching tools, with a working piston which executes a rapid-traverse positioning stroke, a power stroke and a return stroke, with at least one further piston, and with chambers which adjoin these pistons and which, according to a program can be connected to a source of compressed air, in which arrangement a first chamber is pressurized during the positioning stroke and the power stroke, a second chamber is pressurized only during the power stroke and a third chamber is pressurized only during the return stroke and all chambers are vented at other times.

4 Claims, 4 Drawing Figures

PNEUMO-HYDRAULIC BOOSTER WITH RAPID-TRAVERSE FEATURE

DESCRIPTION

The invention relates to a pneumo-hydraulic booster with rapid-traverse feature, particularly for driving punching tools, with a work piston which executes a rapid-traverse positioning stroke, a power stroke and a return stroke, with at least one further piston, and with chambers which adjoin these pistons and which, according to a program, can be connected to a source of compressed air, in which arrangement a first chamber is pressurized during the positioning stroke and the power stroke, a second chamber is pressurized only during the power stroke and a third chamber is pressurized only during the return stroke and all chambers are vented at other times.

A booster of this type has been proposed already in Patent German Application P 28 18 337.1 of the applicants. This is a booster with a doubly stepped working piston, which can be moved in both directions by loading the surfaces of its steps with compressed air, and with a plunger piston, which can also be actuated pneumatically and which causes the hydraulic boosting during the power stroke.

According to this previous proposal, the pressurizing of the second chamber, that is to say the loading of the plunger piston, is effected by means of an excess-pressure valve inserted between the first and second chamber. If in this so-called sequence pressure control the working piston, during its rapid traverse, meets a resistance and stops, the pressure in the first chamber rises up to the delivery pressure of the source of the compressed air due to the air which continues to flow in. During this pressure-rise phase, shortly before reaching the delivery pressure, the excess-pressure valve opens which results in the power stroke being initiated.

It has now been found that this type of change-over from positioning stroke to power stroke still takes up too much time. The object of the invention is, therefore, a more sensitive change-over control which reacts more quickly to the slowing down of the working piston when it meets the workpiece, and which makes it possible to achieve a significant increase in the stroke rate of the booster.

According to the invention, this object is achieved in that for pressurizing and venting the second chamber a change-over valve is provided which can be actuated in dependence on the difference of the pressures in the first and the third chamber. The change-over valve is preferably a differential pressure valve and it is arranged suitably in such a manner that it pressurizes the second chamber, and thus initiates the power stroke, when the pressure in the third chamber has dropped below the pressure in the first chamber by a certain difference.

The determining factor for the time of changeover is thus no longer only the pressure in the first but also the pressure in the third chamber. This is because, considered in detail, this third chamber is not without pressure even though it is vented according to the position of the associated main control valve, during the positioning and power stroke. Rather, due to the rapid positioning movement of the working piston and due to the flow resistances of the feed line and of the main control valve, a pressure head forms in this third chamber which immediately drops when the working piston slows down. This dropping of the pressure head affects the pressure difference considerably more than does the rise of the pressure in the first chamber and is thus the primary determining cause for the unusually short response time of the change-over valve.

Depending on application and adjustment, it is possible that the valve will change over when the positioning movement of the working piston is only slowing down and the working piston has not yet come to a standstill.

Under certain circumstances it can happen that the flow resistances in the venting line of the third chamber are so small, or that the working piston moves so slowly in rapid-traverse that no adequate pressure head will be built up. To provide a remedy in this case, it is proposed in further development of the invention that, into the venting line of the third chamber, which is also the pressure line, a non-return valve, opening towards the chamber, is inserted and that a preferably adjustable flow throttle is connected in parallel thereto. This flow throttle also offers an advantage of being able to set the time of change-over relatively simply and effectively and to match it to the working conditions.

A suitable change-over valve is advantageously a piston slide valve, the two ends of the slider of which are acted on by mutually opposing actuating pistons of different cross-sections, the actuating piston with the larger cross-section being loaded by the pressure in the third chamber and the actuating piston with the smaller cross-section being loaded by the pressure in the first chamber. Pneumatic control lines with small cross-sections are adequate as connecting lines.

It is appropriate to perform the setting of the time of change-over in accordance with the special driving task of the booster just at these thin connecting lines by means of correspondingly small valves and control elements. This knowledge is used as the basis for the proposal to insert a non-return valve into the connecting line from the actuating piston of larger cross-section to the third chamber, which valve closes in this direction, and in parallel to the non-return valve to connect a flow throttle. The operational advantage of this circuit lies in that the slider works in a particularly vibration-free manner.

As an alternative thereto, the arrangement could be such that a non-return valve is inserted into the connecting line from the first chamber to the actuating piston of smaller cross-section, which valve closes in this direction, and that in parallel to the non-return valve a flow throttle is connected. In this and the preceding proposal the flow throttle is preferably constructed to be adjustable.

A considerable advantage of the invention with respect to the known sequence pressure control, described initially, consists in that the rapid traverse can be run with the full air pressure permitted for the cylinder housing with respect to its strength, as a result of which the rapid-traverse power of the working piston is also correspondingly great.

In the text which follows, illustrative embodiments of the invention are explained in greater detail with the aid of the drawing, in which.

Figure 1:
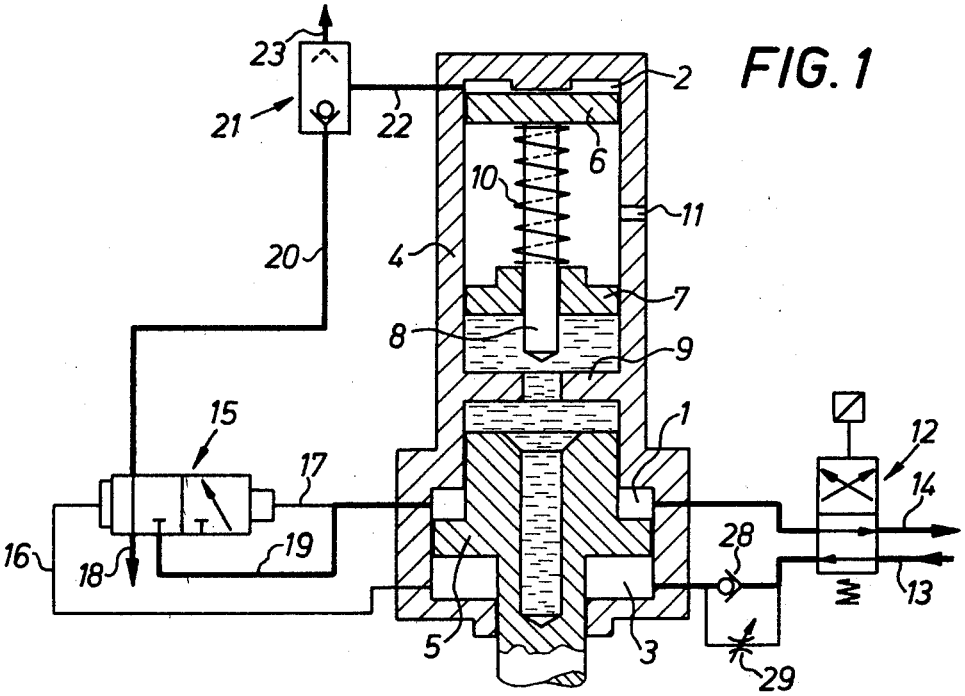
FIG. 1 shows a diagrammatic longitudinal section of a pneumo-hydraulic booster with the associated pneumatic circuit diagram.

In FIG. 1 the three chambers of interest, which can be connected to a compressed-air line system, are designated in accordance with the previous numbering by 1, 2 and 3. In a housing 4 a doubly stepped working piston 5, a plunger piston 6 and an annular piston 7 are arranged. The plunger 8 attached to the plunger piston 6 is able to pass through the central opening of a partition 9 of the housing 4, while simultaneously sealing this partition, and to thrust into a longitudinal boring of the working piston 5. A compression spring 10 is clamped between the annular piston 7 and the plunger piston 6. The spring chamber is connected to the outside air via an opening 11. The spaces between the annular piston 7 and the working piston 5 are filled with hydraulic oil.

The chambers 1 and 3 are connected to a source of compressed air 13 and a venting line 14 via a main control valve 12 which can be actuated electromagnetically.

Figure 2:
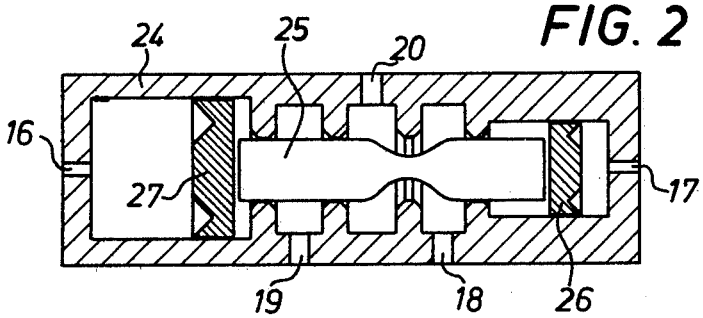
FIG. 2 shows a diagrammatic longitudinal section of the change-over valve used for controlling the plunger piston.

An impulse change-over valve with differential piston actuation, shown in greater detail in FIG. 2, is given the designation 15 in FIG. 1. It has two control connections which are connected to the chambers 3 and 1 via the control lines 16 and 17, respectively. Of the three switching connections one is joined to a venting line 18, the second to a connecting line 19 to chamber 1 and the third to a connecting line 20 which leads to the chamber 2 via a rapid venting valve 21 and a further connecting line 22. The venting connection of the rapid venting valve is designated by 23.

In the diagrammatic representation according to FIG. 2 the impulse change-over valve 15 is provided with a housing 24 in which a slider 25 and, at the ends of the slider, an actuating piston 26 with a smaller cross-section and an actuating piston 27 with a larger cross-section are arranged. This shows that with a pressure difference between the control lines 16 and 17, which depends on the difference in cross-sections of the actuating pistons 26 and 27, the actuating forces cancel out while with a drop or a rise in the pressure difference the slider 25 will move to the left or to the right.

The arrangement according to FIG. 1 acts in the following way: In the situation shown the working piston 5 is on its return stroke into the rest position. The chamber 3 is pressurized and the chamber 1 vented. Thus the impulse change-over valve 15 also assumes the shown position in which the connecting line 20 is without pressure and the chamber 2 is vented via the rapid-venting valve 21.

If now the solenoid valve 12 changes over, the working piston 5 moves downward in rapid traverse. During this process it sucks further hydraulic oil through the opening in the partition 9 and the annular piston 7 sinks downward correspondingly.

Due to the relatively rapid movement of the working piston 5, the full delivery pressure is not yet available in the chamber 1. In the chamber 3 a pressure head of approximately 1.8 bar arises. If the pressure head is inadequate a non-return valve 28 and, parallel to this, an adjustable throttle 29 can be inserted into the connecting line from the chamber 3 to the main control valve 12, as also indicated in FIG. 1. This throttle 29 is operative during the rapid traverse considered here first.

As long as the working piston 5 is still moving rapidly, the pressure head in the chamber 3 is large enough for the actuating piston 27 to overcome the opposing force of the smaller actuating piston 26. As soon as the working piston 5, however, slows down or comes to a standstill as a consequence of meeting the workpiece, the pressure head drops very rapidly so that now the relationship of the forces at the slider 25 changes in favour of the smaller actuating piston 26 and, as a consequence, the change-over valve moves into the left-hand position. The driving air pressure now gets to the rapid-venting valve 21 via the chamber 1, and from there via the connecting line 22 to the chamber 2 whilst the venting connection 23 is closing simultaneously. The plunger piston 6 loaded in this manner drives the plunger 8 downwards and thus effects the power stroke of the working piston 5 with intensification of the hydraulic force.

After the main control valve 12, which can be actuated electromagnetically, has changed over, the working piston again starts its return stroke, the changeover valve 15 immediately resumes the position shown and the rapid-venting valve 21 opens the venting connection 23 for the chamber 2 so that the plunger also resumes its initial position under the action of the compression spring 10 and the hydraulic pressure.

If the cross-sections of the actuating pistons 26 and 27 are adjusted correctly, and if the throttle 29 is adjusted in accordance with the conditions given in operation, working speeds of up to 300 strokes per minute can be achieved with the booster described, a customary operational compressed-air network with approximately 6 to 10 bar being provided as a source of compressed air and the main control valve 12 being switched electrically.

Figure 3:
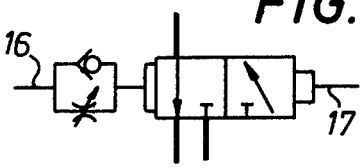
FIG. 3 shows a variation of the circuit diagram and FIG. 4 shows a further variation of the circuit diagram.

According to FIG. 3, into the control line 16 a non-return valve is inserted which closes the impulse change-over valve 15 off the chamber 3, and in parallel thereto an adjustable throttle is inserted. This variant can be employed in addition to the corresponding control elements 28 and 29, connected in parallel, but it can particularly also replace these. The control elements in the considerably thinner control line 16 can be correspondingly smaller.

Figure 4:
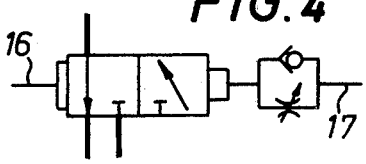

Finally, FIG. 4 shows a further variant of the control circuit, according to which a non-return valve and an adjustable throttle are connected in parallel with each other into the control line 17. Here the non-return valve closes in the direction from the chamber 1 to the actuating piston 26.

I claim:

1. A pneumo-hydraulic booster having a rapid-traverse operation for driving a punching tool comprising a housing having first, second and third chambers therein;

a first piston mounted to slide within said housing to repeatedly drive the punching tool by means of a power stroke and a return stroke;

said first and third chambers being selectively connectible to sources of pressure fluid and a venting atmosphere;

a second piston mounted to slide within said housing and positioned in tandem with said first piston, said second chamber being located on the side of said second piston remote from said first piston;

a booster valve having a first connection to said first chamber, a second connection to said third chamber, and a third connection to said second chamber, said booster valve being responsive to the pressure differential between said first and third chambers;

means actuating said first piston by directing pressure fluid into said first chamber, said first chamber thereby having a predetermined pressure to drive said first piston in a direction to establish contact with the punching tool; and said pressure differential being of a value to hold said booster valve in a first position allowing no pressure fluid to pass to said second chamber;

said pressure differential being subject to variation by contact of said first piston with the punching tool, said booster valve thereby being movable to a second position due to said variation of said pressure differential, said second position of said booster valve allowing pressure fluid to pass to said second chamber to drive said second piston in said driving direction to contact said first piston to provide an increased driving force on the punching tool.

2. A pneumo-hydraulic booster according to claim 1 wherein said second piston has a longitudinal plunger attached thereto and extending toward said first piston, said first piston includes a depressed portion adapted to receive said plunger in abutting contact when said booster valve is in said second position, and spring means surrounds said plunger to exert a force biasing said plunger and said second piston in a direction opposite to said driving direction.

3. A pneumo-hydraulic booster according to claim 1 wherein said booster valve includes a slider element having actuating pistons at either end thereof, said actuating pistons being exposed to pressure fluid from said first and third chambers by means of said first and second connections, and said slider element is movable due to said variation in said pressure differential to allow fluid to pass through said booster valve and said third connection into said second chamber.

4. A pneumo-hydraulic booster according to claim 1 wherein a non-return valve is located between said source of pressure fluid and said third chamber to maintain the pressure therein, and an adjustable throttle valve is connected in parallel with said non-return valve.

* * * * *